US006698374B1

(12) United States Patent
Van Der Laan

(10) Patent No.: US 6,698,374 B1
(45) Date of Patent: Mar. 2, 2004

(54) DESIGN FOR TUGBOAT

(75) Inventor: Marcus Van Der Laan, Oegstgeest (NL)

(73) Assignee: Novatug B.V., Rotterdam (NL)

( * ) Notice: Subject to any disclaimer, the term of this patent is extended or adjusted under 35 U.S.C. 154(b) by 0 days.

(21) Appl. No.: 10/070,258

(22) PCT Filed: Aug. 31, 2000

(86) PCT No.: PCT/NL00/00607

§ 371 (c)(1),
(2), (4) Date: Jul. 10, 2002

(87) PCT Pub. No.: WO01/30650

PCT Pub. Date: May 3, 2001

(30) Foreign Application Priority Data

Sep. 3, 1999 (NL) ..... 1012977

(51) Int. Cl.[7] ..... B63B 21/04
(52) U.S. Cl. ..... 114/253; 114/254
(58) Field of Search ..... 114/242, 253, 114/254

(56) References Cited

U.S. PATENT DOCUMENTS 5,609,120 A * 3/1997 Eronen ..... 114/253

FOREIGN PATENT DOCUMENTS

| | | |
|---|---|---|
| DE | 573 091 | 3/1933 |
| DE | 881 312 | 6/1953 |
| EP | 0 672 582 | 9/1995 |
| FR | 568 437 | 3/1924 |
| FR | 1 492 939 | 12/1967 |

* cited by examiner

*Primary Examiner*—Stephen Avila
(74) *Attorney, Agent, or Firm*—Browdy and Neimark, P.L.L.C.

(57) ABSTRACT

The invention relates to a tugboat. The design comprises a towing installation which can turn through 360° in the horizontal plane about a vertical shaft. Above the towing installation there is a pilot house, and beneath it there are one or more propellers. This design provides optimal thrust in all directions in line with the rowing cable, in combination with good resistance and swell properties.

10 Claims, 8 Drawing Sheets

DESIGN FOR TUGBOAT

Figure 1:
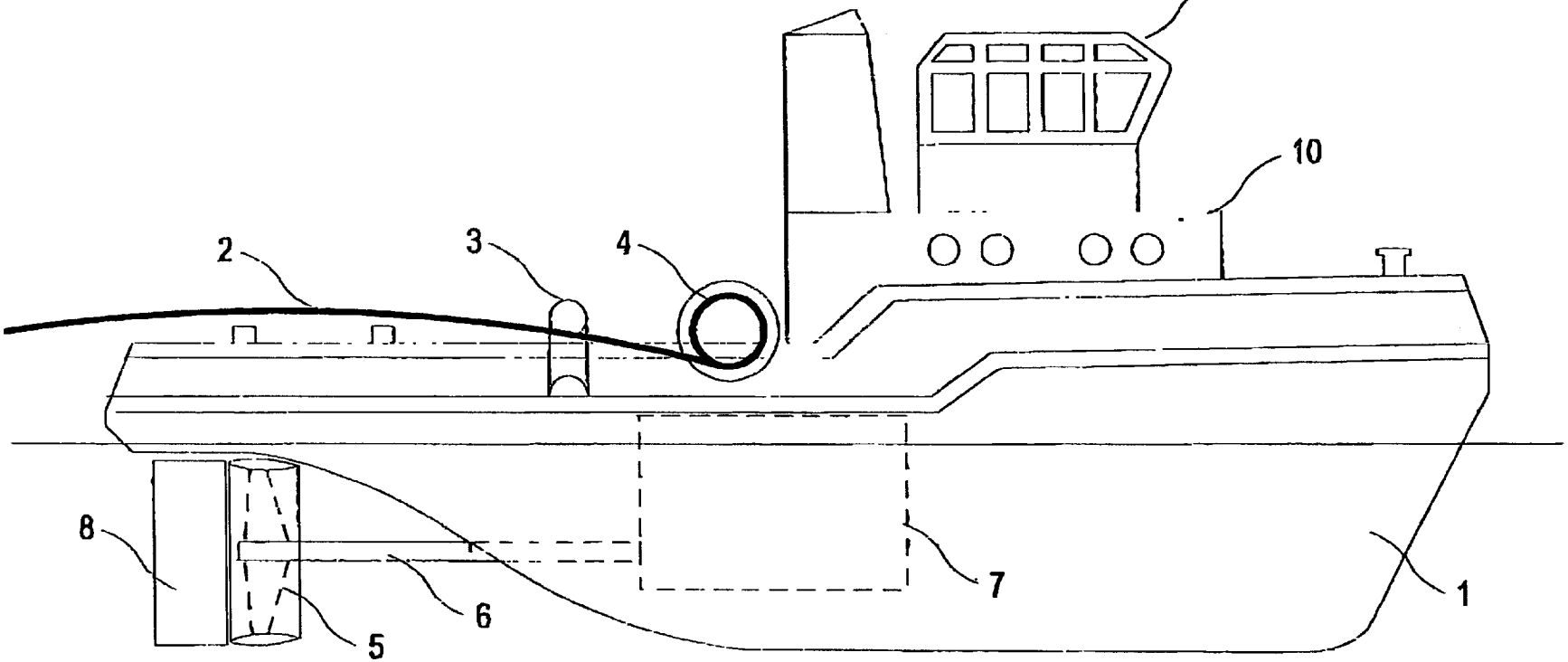

The invention relates to a tugboat. The design comprises a towing installation which can turn through 360° in the horizontal plane, and beneath which there are one or more propellers. This design provides optimal thrust in all directions in line with the towing cable, in combination with good resistance and swell properties.

In harbours and restricted sailing areas, ships are usually assisted by one or more tugboats. The ship and the tugboat are firstly connected by cable. The tugboat sails with the ship and positions itself in such a manner that it can tow the ship in a specific direction by means of the towing cable. During these manoeuvres, it is also possible for a tugboat to be manoeuvred against the ship in order to be able to push it.

During towing, there is a cable connection between the tugboat and the ship. On board the tugboat, this cable usually runs through a towing eyelet and is attached to a towing winch or towing hook. The towing eyelet is arranged as low as possible in the vertical direction on the tugboat, in order to minimize the tilting of the tugboat and to prevent the tugboat from capsizing.

With respect to this towing eyelet, the towing cable can turn sideways through 90° or more in the horizontal plane, towards both boards.

In the case of a towing winch, the cable length can be adapted to the desired towing length and manoeuvring distance. In the case of a towing hook or attachment point, the towing cable length is fixed.

On older models, there is only a winch and a towing eyelet at the stern; in many modern tugboats, a towing eyelet and towing winch are arranged both fore and aft.

During manoeuvring, the tugboat turns with respect to the ship, but on account of the design of the towing eyelet, the tugboat can only turn to a limited extent with respect to the towing cable connection. In this embodiment, the towing installation cannot produce a towing cable connection in all directions independently of the direction of the tugboat (i.e. the longitudinal axis of the ship). It is also not possible for the towing cable to turn through a full 360°, since the towing cable then comes into contact with the deckhouse.

A tugboat provides propulsion by means of one or more screws. Many ships are equipped with two screws positioned next to one another. In older models, these screws are positioned aft beneath the ship by means of a propeller shaft. In this case, the thrust is produced predominantly in the longitudinal direction of the ship. This direction is also directed partially sideways by means of rudders. Modern tugboats are often equipped with so-called thrusters. In this case the entire screw/propulsion unit can turn in the horizontal plane and thrust can be produced in any desired direction. In a number of models, these thrusters are arranged beneath the stern (a so-called azimuth-stern-drive tug), and in a number of models the thrusters are arranged roughly ⅓ of the length from the forward part of the ship (a so-called tractor tug).

In all these designs, there is a horizontal distance in the longitudinal direction of the ship between the resultant propulsive force and the direction of the towing cable. In a number of directions (for example the longitudinal direction), this horizontal distance is zero, but in other directions (for example sideways), this distance is relatively great.

The optimum towing force is obtained if the resultant propulsive force in the horizontal plane is in line with the direction of the towing cable; for this purpose, therefore, the tugboat always has to adopt the desired position and direction.

An exception to this is formed by so-called "dish" designs, i.e. convex, round hull shapes without a clear sailing direction; i.e. the ship can sail both forwards and sideways. In addition, the ship can also turn relatively quickly about its axis. These designs have a small length/width ratio. However, this form of ship has a high resistance, with the result that the design can only reach a moderate speed. During towing, the ship's direction is selected in such a manner that the towing eyelet is positioned in the direction of the vessel which is to be towed. Examples of this include the OMNI 2000 (Robert Allen Ltd) and the Ship Docking Module (SDM) Hvide design (Halter Marine USA). These two designs are distinguished by a flat, shallow hull with one thruster at the front on one board and the other thruster at the stern on the opposite board. Similar designs are based on a roughly round shape with two, three or more thrusters. However, this form of ship has an adverse effect on the resistance of the ship (in particular at increasing speeds), and results in a poor sailing performance in rough seas. In many cases, it is impossible to sail on the sea.

Furthermore, conventional tugboat designs are aimed at achieving a high thrust at low speed during towing, the hull shapes being conventional and unsuitable for reaching (relatively) high speeds.

It is clear from this that there are no satisfactory solutions for obtaining the full thrust in line with the towing cable, independently of the ship's direction and in combination with good resistance and swell properties.

The object of the present invention is to provide an improved device which does not have the drawbacks described above, i.e. to obtain full thrust in all directions in line with the towing cable, independently of the ship's direction and in combination with good resistance and swell properties.

This object is achieved by arranging a towing installation which can turn through 360° in the horizontal plane and can rotate irrespective of the direction of the tugboat. This turnable towing installation may comprise all designs which are known in the prior art. It is possible for a conventional towing winch, possibly in combination with a towing eyelet, to be placed on a rotatable platform. Another possibility is for a winch drum to be positioned so that it turns around a vertical shaft. The winch drum and towing eyelet may comprise all designs which are known in the prior art, of numerous forms and dimensions. In addition, the winch drum can be driven in numerous ways.

According to another advantageous design, the towing installation rotates about a predominantly vertical connection to a facility for visual observation of the surrounding area. This facility may comprise all designs which are known in the prior art.

The facility may comprise a visual recorder which records information about the surrounding area and makes this information available for steering the ship. In this case, consideration may be given to a camera with electrical information exchange or an optical installation (with lenses/mirrors) which transmits light rays.

The facility may also comprise an (observation) station for one or more people. In this case, consideration may be given to a deckhouse at which one or more people may be stationed.

According to another advantageous design, the (observation) station for one or more people also includes a steering/operating installation for the tugboat.

According to another advantageous design, the (observation) station for one or more people is positioned at the top side of the vertical shaft, so that the towing installation can rotate without interference. This design produces a low point of action of the towing cable on account of the low position of the towing installation and good visual observation of the surrounding area on account of the high position of the (observation) station. If the steering/operating installation is also arranged at this (observation) station, it is possible for one or more people to manoeuvre the tugboat.

According to another advantageous design, the vertical shaft is designed to have a considerable diameter, resulting in a relatively flat drum of large diameter. The lower height of the drum produces a lower point of action, with the result that the tugboat is much less prone to capsizing. In addition, the flat drum leads to a shorter arm, so that the shaft is better able to absorb the bending moment.

The large diameter of the drum does result in a rotating couple in the horizontal plane, which has to be absorbed by the tugboat. On account of the larger diameter, fewer turns of the towing cable are required, and the cable can be wound up easily without it being necessary to use separate moving guide eyelets.

According to another advantageous design, the drum is provided with a rotating, guiding towing eyelet. The use of a drum with a large diameter allows the rotating towing eyelet to reduce the capsizing movement. As a result of the towing eyelet also being allowed to turn with respect to the drum by means of a drive unit, it is possible for the point of action of the towing force to coincide with the vertical centre axis of the vertical rotation shaft; as a result, there is no rotational couple in the horizontal plane acting on the tugboat. If the towing eyelet and the drum together can turn freely, independently of the ship's direction, the drum together with the towing eyelet will automatically turn towards the object which is to be towed.

According to another advantageous design, the vertical shaft is designed as a hollow shaft, with the result that from the (observation) station it is possible to gain access to the hull/inside of the ship, while the towing installation can turn without obstacle through 360° in the horizontal plane. The crew can move without obstacle and safely between the (observation) station and the hull of the ship, where the engines for propulsion are generally accommodated.

According to another advantageous design, one or more propellers are arranged in the vertical plane perpendicularly beneath or in the vicinity of the turnable towing installation, in such a manner that the resultant of the thrust can act in the horizontal plane in line with the towing cable direction. If one propeller is used, it will be arranged in the vertical plane perpendicularly beneath or in the vicinity of the turnable towing installation. In this way, it is possible for the optimum thrust throughout the entire 360° in the horizontal plane to be realized in line with the towing cable direction by means of the turnable towing installation. If there are a plurality of thrusters, they will generally be arranged symmetrically with respect to the vertical shaft passing through the towing installation. In this way too it is possible to achieve the optimum thrust throughout the entire 360°. However, at a number of angles there will be a slight loss of thrust as a result of one propeller lying in the flow of the other.

According to another advantageous design, the position of the turnable towing installation and the propeller(s) is selected in such a manner with respect to the shape of the ship that the ship's direction follows the thrust direction of the propeller(s). This can be achieved by positioning the propeller(s) half way along the length of the ship or by adapting the shape of the ship in such a manner that a large part of the lateral surface is positioned behind the propeller (s). Additional fins, also known as cutwaters, can have a beneficial effect on this sailing performance, as is already customary in a number of tractor tugs. In this design, after the desired thrust direction has been set, the ship will automatically sail starting from this direction. In this case, the captain can adapt the thrust direction as desired in the customary way. This direction is then set relative to the ship's direction.

Another possibility is for the captain to be able to set the desired thrust direction independently of the ship's direction. This so-called absolute thrust direction may, for example, be achieved by relating the direction to absolute North by means of a (gyro)compass. When not towing, the tugboat, after this thrust direction has been set, will automatically sail in this direction. When towing, the tugboat, after this thrust direction has been set, will automatically manoeuvre itself into the optimum direction and position with respect to the object to be towed. This design can be used both with a stationary object to be towed and with a sailing object to be towed. In this case, it is also possible for the direction of the steering/operating installation to be selected in absolute terms, so that the orientation of the captain is no longer dependent on the ship's direction, but rather on, for example, absolute North.

According to another advantageous embodiment, the tugboat hull shape and the propeller are selected in such a manner that the propeller can produce a high thrust at both low and high speeds and that the hull shape has favourable resistance properties even at relatively high speeds. With regard to the propeller, consideration should be given here in particular to adjustable screws which can produce a high thrust over a wide range of inflow speeds. With regard to the hull shape, consideration should be given in particular to a high-speed "aquaplaning" hull shape, in which as the speed increases the ship is lifted out of the water by the dynamic upward pressure and can produce a considerable rise in speed compared to the wave velocity.

According to another advantageous embodiment, a second towing eyelet is positioned next to the towing eyelet in the turnable towing installation, above the centre of gravity of the lateral hydrodynamic resistance. This second towing eyelet may be closed, as is the case with a conventional towing eyelet, but may also be provided with an opening, optionally provided with a locking means. When using vertical cutwaters, the second towing eyelet will be arranged in the horizontal plane above the latter. This design makes it possible, when sailing at reasonably high speeds, to utilize the hydrodynamic lifting force of the cutwater in order to produce an additional towing force.

According to another advantageous embodiment, two or more cutwaters are positioned at a slight angle with respect to the vertical. On account of the inclined position, the cutwaters predominantly produce a high transverse force, but by specifically selecting the angle of the cutwaters, one or more cutwaters produce(s) a slight upward vertical force and one or more cutwaters produce(s) a slight downward vertical force. This vertical couple of forces counteracts the capsizing moment of the towing cable.

The invention will be explained in more detail below with reference to the exemplary embodiments illustrated in the drawings, in which:

FIG. 1 diagrammatically depicts a side view of a conventional tugboat.

Figure 2:
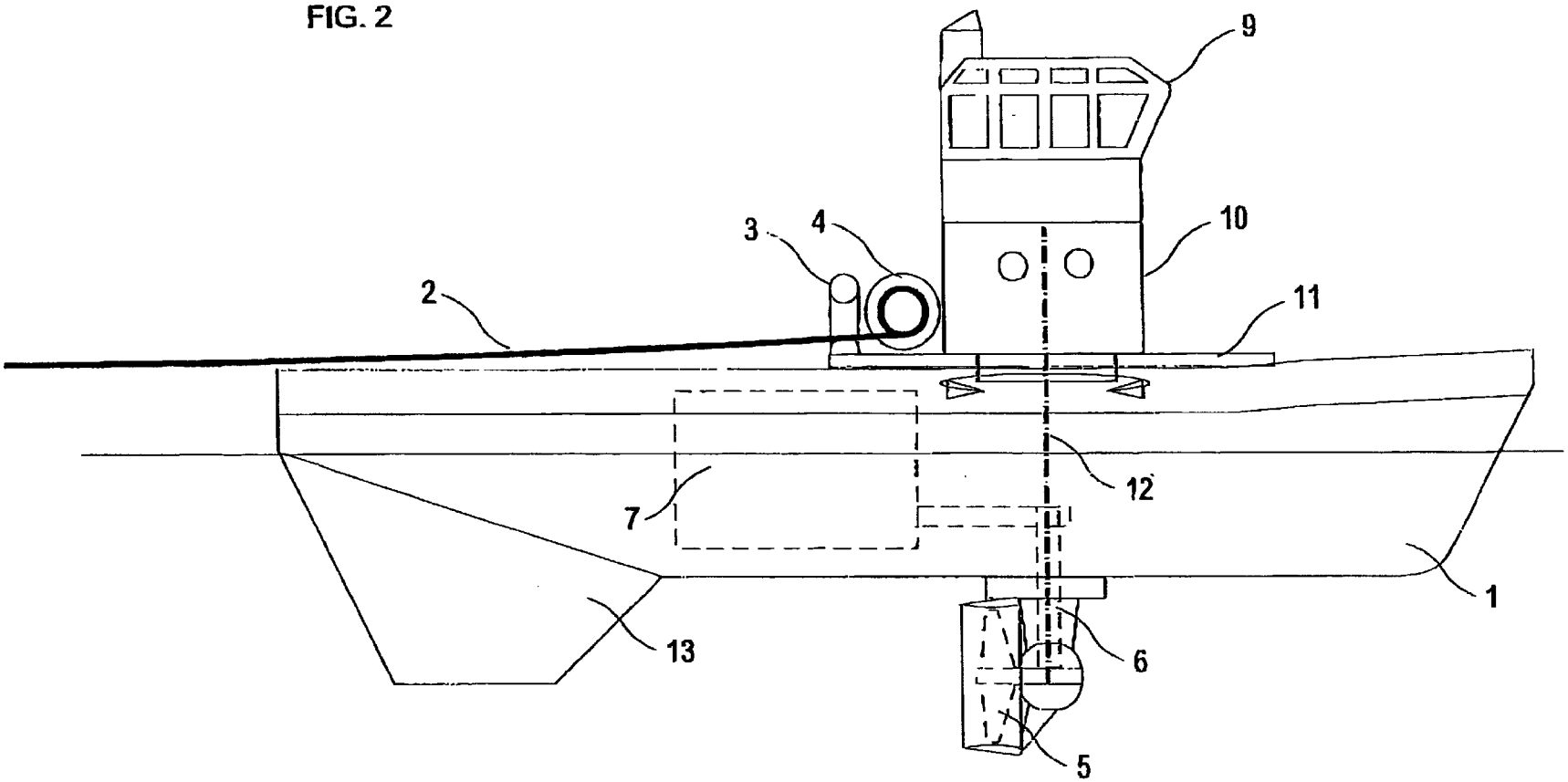

FIG. 2 diagrammatically depicts a side view of the present invention with a first embodiment of the towing winch installation.

Figure 3:
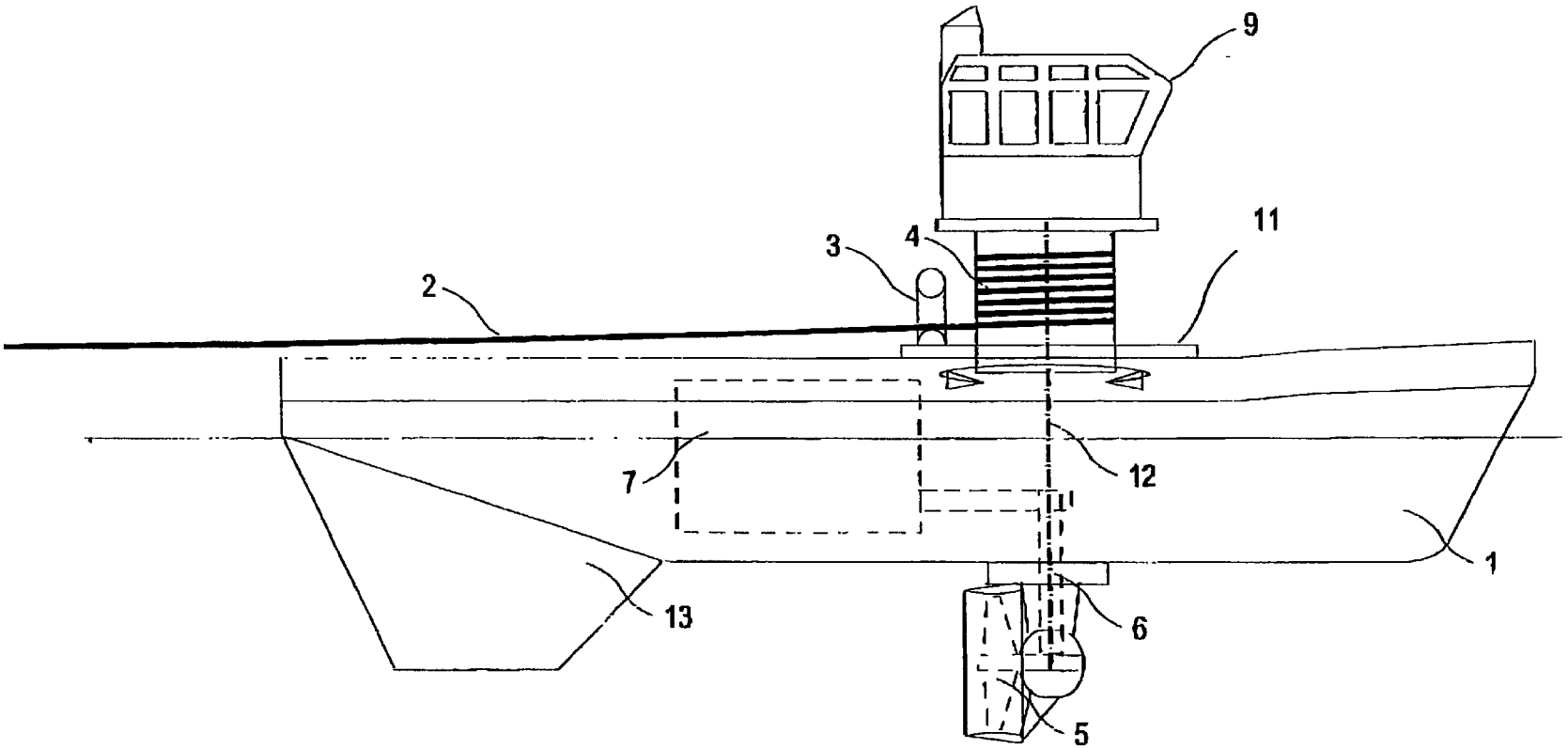

FIGS. 3 and 4 diagrammatically depict side and plan views of the present invention with a second embodiment of the towing winch installation.

Figure 5:
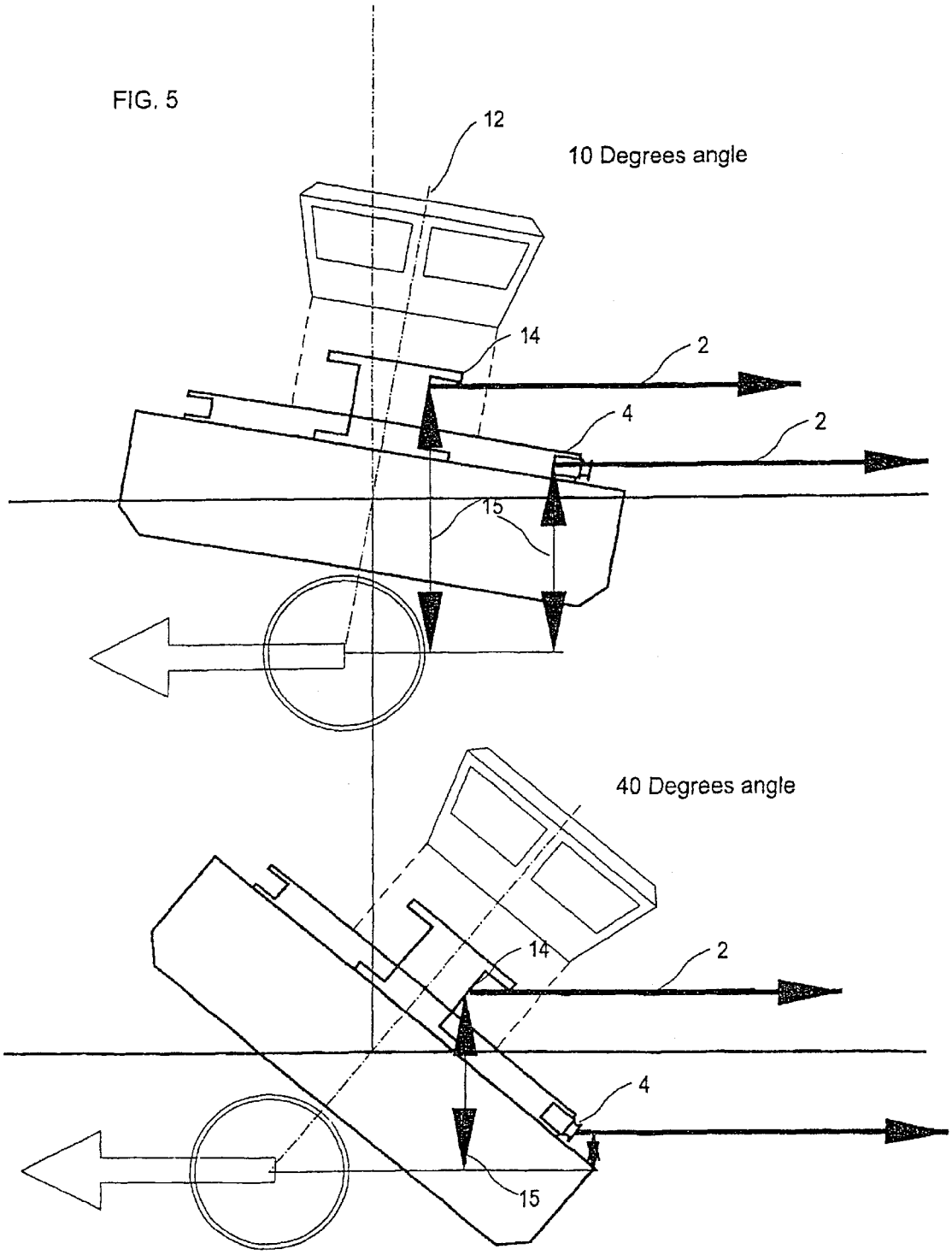

FIG. 5 diagrammatically depicts a cross section illustrating the reduction in the capsizing moment as a result of a relatively flat drum of large diameter.

FIG. 6 diagrammatically depicts the principle of the absolute thrust direction.

FIG. 7 shows front, side and plan views of the present invention for a high-speed hull shape.

Figure 8:
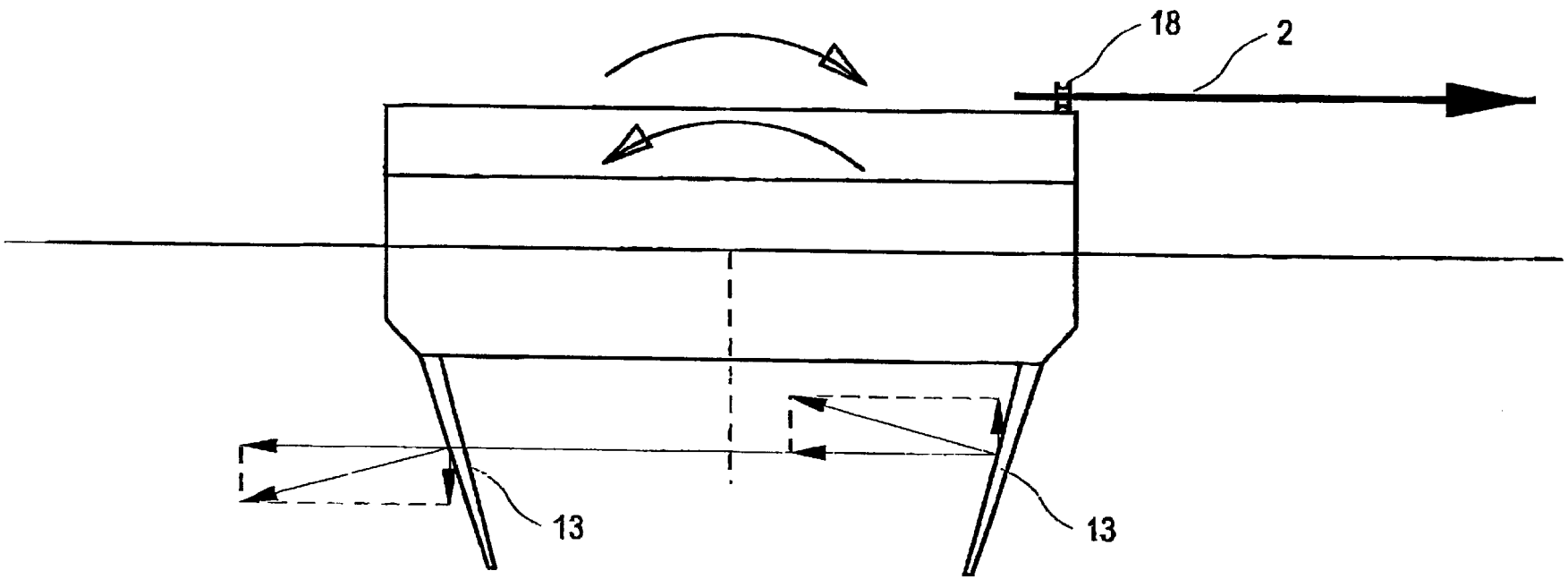

FIG. 8 diagrammatically depicts a cross section illustrating the use of inclined cutwaters for absorbing the capsizing moment of the towing cable.

FIG. 1 shows a conventional twin-screw tugboat 1 having the following components: towing cable 2, towing eyelet on the aft part 3 of the ship, towing winch 4, a conventional propeller comprising two screws 5 arranged next to one another, two propeller shafts 6 and two engines 7. A separate rudder 8 is arranged behind both screws. The figure also shows the accommodation 10 for the crew and the deckhouse 9, from which the captain observes the surrounding area and manoeuvres the ship.

FIG. 2 shows the new tugboat design 1, having the following components: towing cable 2, the new towing winch installation comprising a horizontal platform 11 which turns about the vertical rotation shaft 12 illustrated and, fixedly connected thereto, a towing eyelet 3 and a towing winch 4, as well as two screws 5 positioned next to one another in two thruster units which turn in the horizontal plane, two driving (propeller) shafts 6 and two engines 7. The resultant force from the two thrusters together coincides in the horizontal plane with the towing cable force passing through the rotation shaft of the towing winch installation. The accommodation 10 and the (observation) station/deckhouse 9 are fixedly connected to the ship by means of the rotation shaft; the towing winch installation can turn freely around these parts. Furthermore, a cutwater 13 is shown beneath the aft part of the ship.

FIG. 3 shows the tugboat design 1 with a variant of the towing winch installation, having the following components: towing cable 2, the novel towing winch installation comprising a vertical drum, which turns around the vertical rotation shaft 12 shown, of the towing winch 4, an optional horizontal platform 11 which turns about the same rotation shaft and an optional towing eyelet 3 fixedly connected thereto, and once again two screws 5, two driving (propeller) shafts 6 and two engines 7. The (observation) station/deckhouse 9 is once again fixedly connected to the ship by means of the rotation shaft; the towing winch installation can turn freely around this shaft. Furthermore, a cutwater 13 is shown beneath the aft part of the ship. The following three designs exist for the winch drive mechanism.

a) No towing eyelet: towing winch drum is driven and hauls in or pays out the towing cable.

b) Towing eyelet without drive: the towing winch drum is driven as in a), while the towing eyelet can turn freely about rotation shaft.

c) Towing eyelet with combined drive with towing winch drum: drive drives towing eyelet with respect to towing winch drum, while both can move freely together around the rotation shaft.

Figure 4A:
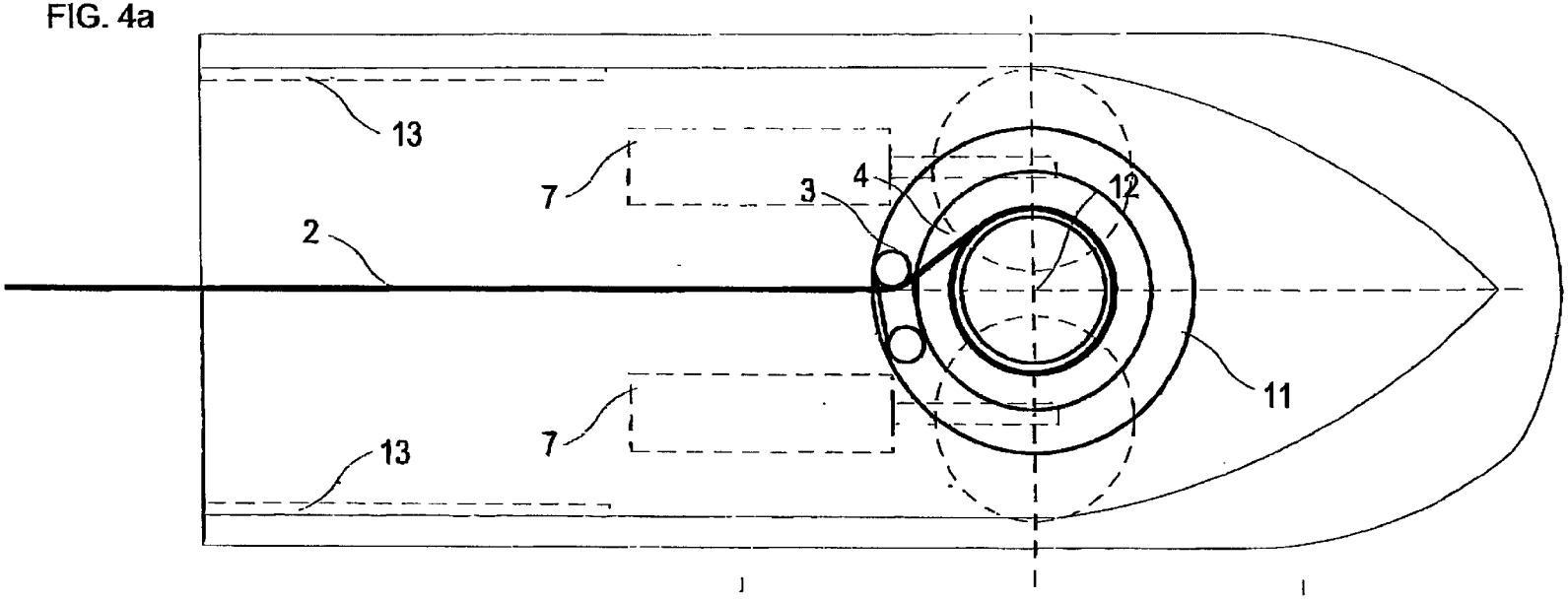
Figure 4B:
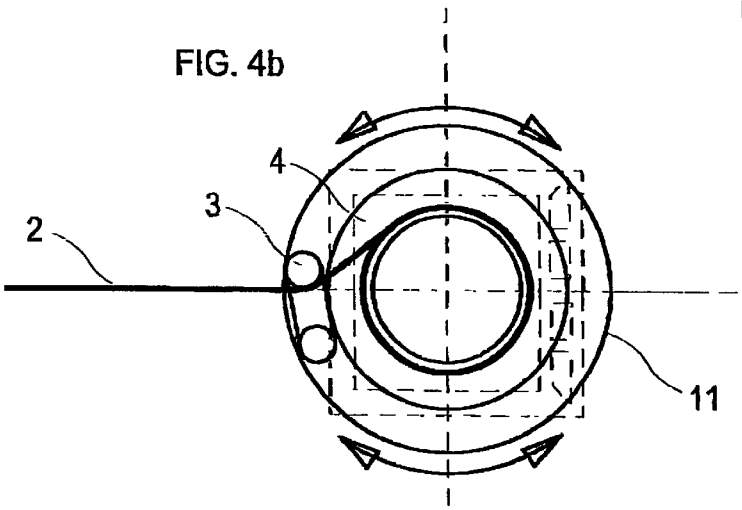
Figure 4C:
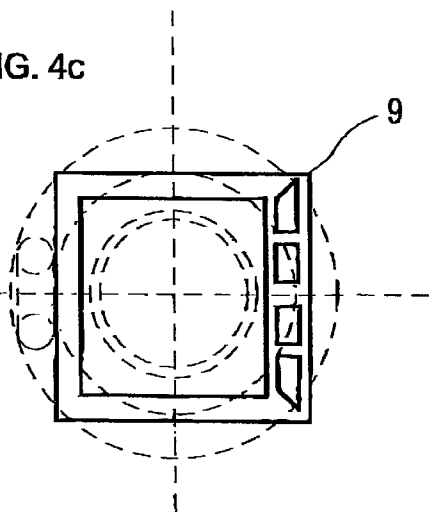

FIG. 4 once again shows the tugboat design 1, in plan view: FIG. 4*a* shows the plan view of the deck, FIG. 4*b* shows the plan view of the drum 4 and FIG. 4*c* shows the plan view of the (observation) station/deckhouse 9. In this case, this figure shows the combined drive of the towing eyelet 3 fixedly connected on the horizontal platform 11 and the towing winch drum 4, which can rotate freely about the vertical rotation shaft 12 shown. As a result, the towing cable is directed towards the centre axis of the drum. Furthermore, the two cutwaters 13 are once again shown.

FIG. 5 shows a variant of the tugboat design 1 in cross section, with a relatively high drum 14 and a relatively flat drum 4 of large diameter. The vertical arm 15 between the thrust and towing cable forces decreases as the diameter of the drum increases.

Figures 6A, 6B:
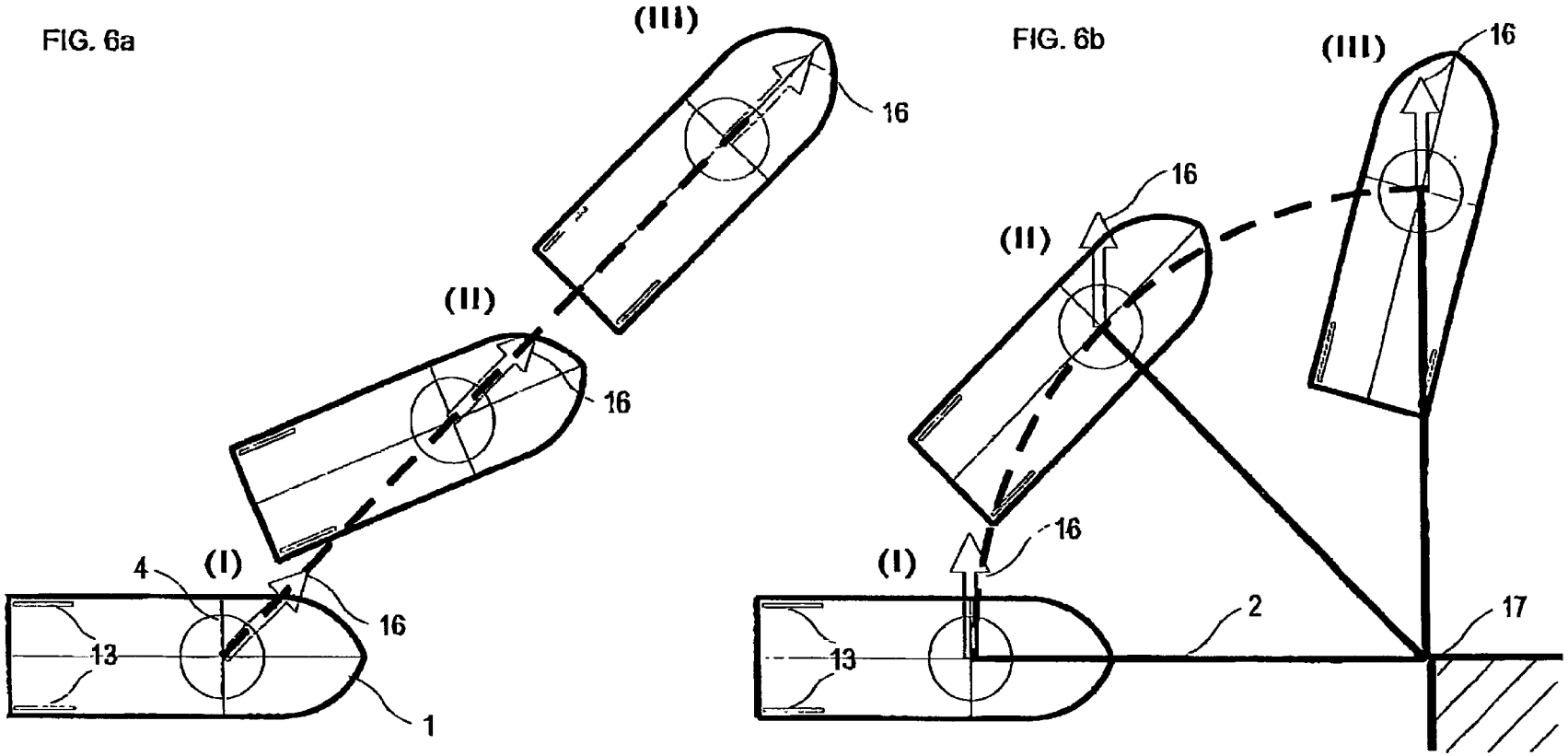

FIG. 6 illustrates the absolute thrust principle in three steps. FIG. 6*a* relates to the situation when towing is not taking place. After a thrust direction 16 has been selected, the tugboat will move out of situation (I) via situation (II) towards situation (III), in which the ship is moving in the direction of the thrust. FIG. 6*b* relates to the situation with a towing cable 2 connected to the object 17 which is to be towed. After the thrust direction 16 has been selected, the tugboat will describe an arc of a circle around the object to be towed, until the thrust direction 16 lies in line with the towing cable and the most optimum thrust is achieved. The ship's direction is in this case independent of the thrust direction and is determined by the sailing direction towards the optimum towing position.

Figures 7A, 7B, 7C:
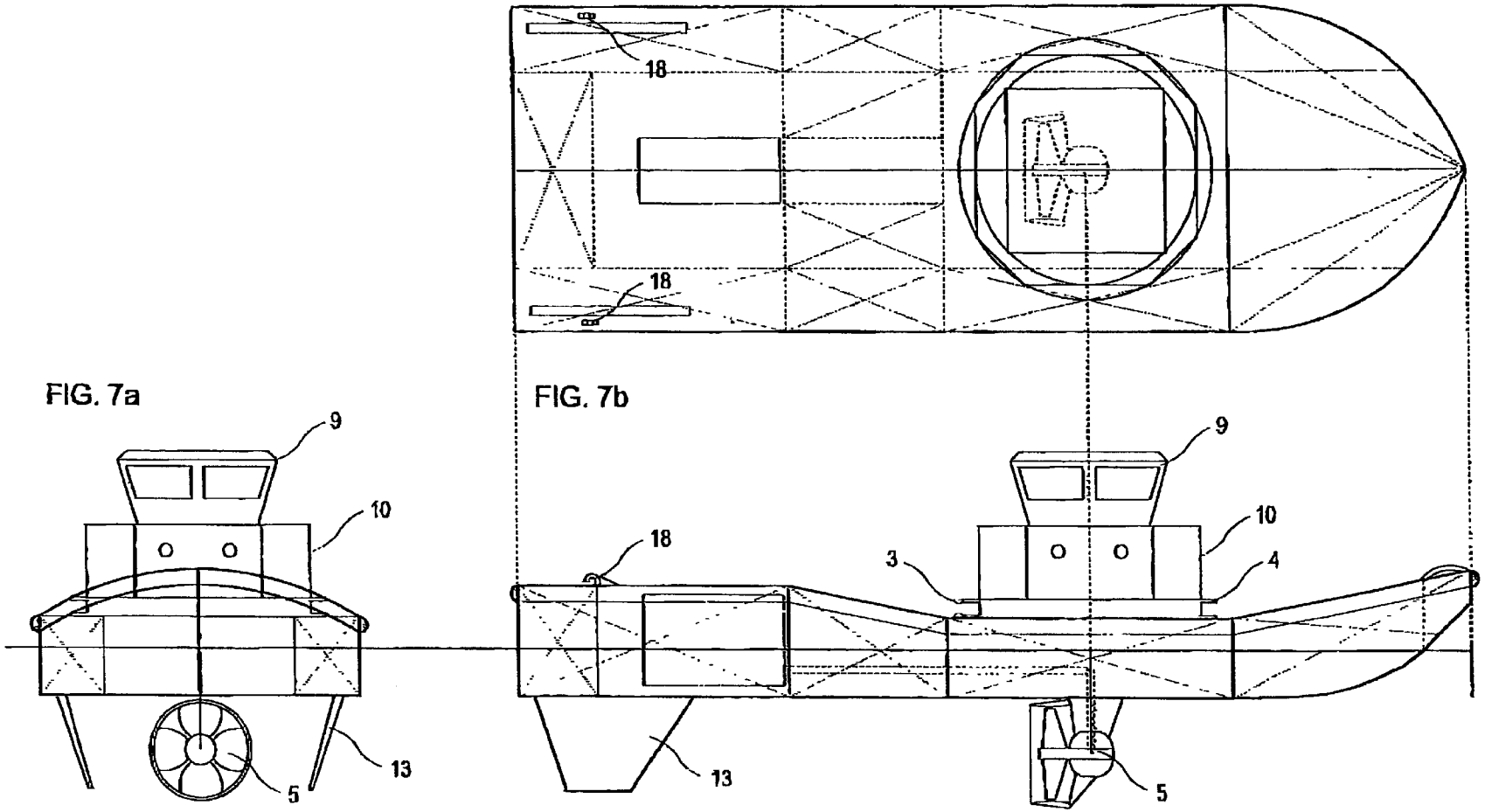

FIG. 7 shows the tugboat design with the high-speed hull shape. FIG. 7*a* shows a cross section, FIG. 7*b* shows a side view and FIG. 7*c* shows a plan view. The shape of the hull can be seen clearly in the three drawings, with a flat bottom aimed at achieving a high vertical dynamic lift, so that the design starts to aquaplane at relatively high speeds. The design also shows a second towing eyelet 18 on both sides, vertically above the two cutwaters.

FIG. 8 shows the tugboat design with the inclined cutwaters, in cross section. The towing cable 2 pulls on the tugboat and forms a (slight) capsizing moment. The right-hand cutwater 13 provides a large horizontal component directed towards the left and a slight upward vertical component. The left-hand cutwater 13 likewise supplies a horizontal component and also a slight downward vertical component. The couple of the two vertical components provides a moment which opposes the capsizing moment of the towing cable.

Although the invention has been described above with reference to a preferred embodiment, numerous modifications may be made without departing from the scope of the present application. The turnable towing installation may be arranged at all kinds of positions on the vessel. It is also possible to use all kinds of different forms of thrust and hull shapes.

What is claimed is:

1. Tugboat comprising a ship's hull whereon is fitted a turnable towing installation, that can turn about 360 degrees with respect to that ship's hull in the horizontal plane, and that can turn about a substantially vertical connection to a station/deckhouse of the ship, said connection forming a solid connection between the station/deckhouse of the ship and the ship's hull, wherein said ship's hull is oblong and said turnable towing installation comprises a winch drum or towing point which turns about a substantially vertical shaft, wherein the diameter of the substantially vertical shaft is greater than half the width of the ship, and wherein the station/deckhouse of the ship is positioned at the top side of the substantially vertical shaft.

2. Tugboat according to claim 1, wherein the station/deckhouse of the ship includes a steering/operating installation.

3. Tugboat according to claim 1, wherein the steering/operating installation is solidly connected to the station/deckhouse of the ship.

4. Tugboat according to claim 1, wherein the substantially vertical shaft is designed as a hollow shaft.

5. Tugboat according to claim 1, wherein one or more propellers are arranged in the vertical plane beneath or in the vicinity of the turnable towing installation, such that the combined thrust can act in the horizontal plane in the vicinity of an extension of the towing cable, by means of the towing installation.

6. Tugboat according to claim 1, wherein the hull shape and propeller are selected in such a manner that the tugboat produces a high thrust both at low speeds and at high speeds, and the hull shape has favorable resistance properties even at relatively high speeds.

7. Tugboat according to claim 1, wherein a second towing eyelet is provided in the vertical plane above or in the vicinity of the center of gravity of lateral hydrodynamic resistance.

8. Tugboat according to claim 1, wherein two or more cutwaters are arranged at a slight angle with respect to the vertical, in such a manner that the vertical dynamic couple of forces of the cutwaters counteracts the capsizing moment of the towing cable.

9. Tugboat comprising a ship's hull whereon is fitted a turnable towing installation, that can turn about 360 degrees with respect to that ship's hull in the horizontal plane, and that can turn about a substantially vertical connection to a station/deckhouse of the ship, said connection forming a solid connection between the station/deckhouse of the ship and the ship's hull, wherein said ship's hull is oblong and said turnable towing installation comprises a winch drum or towing point which turns about a substantially vertical shaft, wherein the diameter of the substantially vertical shaft is greater than half the width of the ship, and wherein a towing eyelet can rotate about the winch drum, and in which the towing eyelet can be turned with respect to the winch drum by a drive unit, with the result that the point of action of the towing force coincides with the vertical center axis of the substantially vertical rotation shaft.

10. Tugboat comprising a ship's hull whereon is fitted a turnable towing installation, that can turn about 360 degrees with respect to that ship's hull in the horizontal plane, and that can turn about a substantially vertical connection to a station/deckhouse of the ship, said connection forming a solid connection between the station/deckhouse of the ship and the ship's hull, wherein said ship's hull is oblong and said turnable towing installation comprises a winch drum or towing point which turns about a substantially vertical shaft, wherein the diameter of the substantially vertical shaft is greater than half the width of the ship, and wherein the turnable towing installation and the position of the propellers are selected in such a manner with respect to the tugboat hull that, as a result of the direction of the thrust being selected independently of the ship's direction, the tugboat, when sailing freely, automatically begins to sail in this thrust direction, and the tugboat, when towing, automatically maneuvers into the optimum direction and position with respect to the object which is to be towed.

* * * * *